US007613409B2

(12) United States Patent
Furushige

(10) Patent No.: US 7,613,409 B2
(45) Date of Patent: Nov. 3, 2009

(54) IMAGE FORMING APPARATUS

(75) Inventor: Katsuji Furushige, Osaka (JP)

(73) Assignee: Kyocera Mita Corporation (JP)

( * ) Notice: Subject to any disclaimer, the term of this patent is extended or adjusted under 35 U.S.C. 154(b) by 435 days.

(21) Appl. No.: 11/729,597

(22) Filed: Mar. 29, 2007

(65) Prior Publication Data

US 2007/0253724 A1 Nov. 1, 2007

(30) Foreign Application Priority Data

Apr. 28, 2006 (JP) ..... 2006-125948

(51) Int. Cl.
*G03G 15/00* (2006.01)

(52) U.S. Cl. ..... 399/43; 399/58; 399/27

(58) Field of Classification Search ..... 399/75, 399/43, 254, 258, 58, 59
See application file for complete search history.

(56) References Cited

U.S. PATENT DOCUMENTS 4,777,512 A * 10/1988 Takahashi et al. ..... 399/30
4,975,742 A * 12/1990 Tada et al. ..... 399/62
6,212,341 B1 * 4/2001 Miyamura et al. ..... 399/58
6,404,997 B1 * 6/2002 Grace ..... 399/27
7,136,089 B2 * 11/2006 Able et al. ..... 347/262
7,450,867 B2 * 11/2008 Itoyama et al. ..... 399/27
7,450,868 B2 * 11/2008 Kunikawa, Norihide ..... 399/27

FOREIGN PATENT DOCUMENTS

JP 2005-164676 6/2005

* cited by examiner

*Primary Examiner*—David M Gray
*Assistant Examiner*—Roy Yi
(74) *Attorney, Agent, or Firm*—Gerald E. Hespos; Anthony J. Casella

(57) ABSTRACT

A delaying section for obtaining from an image processing section a printing rate of image data used for forming a toner image, and delaying in accordance with the obtained printing rate a start timing of a toner image forming by the toner image forming section. The delaying section does not delay the start timing of the present toner image forming by the toner image forming section in the case where the when a printing rate of image data for the preceding toner image forming and a printing rate of image data for the present toner image forming are the same. In the case where the printing rates are different from each other, the delaying section delays the start timing for the present toner image a predetermined delaying time, the predetermined delaying time being predetermined in accordance with a printing rate of image data determined for the present toner image forming.

12 Claims, 6 Drawing Sheets

80

FIG. 5

| PRINTING RATE (%) | PREDETERMINED NUMBERS OF SHEETS | DELAYED TIME (msec) |
|---|---|---|
| NOT LESS THAN 30% BUT LESS THAN 35% | 0 | 0 |
| NOT LESS THAN 35% BUT LESS THAN 40% | 0 | 0 |
| NOT LESS THAN 40% BUT LESS THAN 45% | 16 | 500 |
| NOT LESS THAN 45% BUT LESS THAN 50% | 16 | 500 |
| NOT LESS THAN 50% BUT LESS THAN 55% | 14 | 1000 |
| NOT LESS THAN 55% BUT LESS THAN 60% | 14 | 1000 |
| NOT LESS THAN 60% BUT LESS THAN 65% | 12 | 1500 |
| NOT LESS THAN 65% BUT LESS THAN 70% | 12 | 1500 |
| NOT LESS THAN 70% BUT LESS THAN 75% | 10 | 2000 |
| NOT LESS THAN 75% BUT LESS THAN 80% | 10 | 2000 |
| NOT LESS THAN 80% | 8 | 2500 |

IMAGE FORMING APPARATUS

BACKGROUND OF THE INVENTION

1. The present invention relates to an image forming apparatus. More particularly, it relates to a technique of forming a toner image on an image bearing member.

2. Description of the Related Art. Conventionally, in an image forming apparatus disclosed in the Japanese Unexamined Patent Publication No. 2005-164676, when a printing rate (a ratio of dots bearing toner particles with respect to all dots in print image data) of an image on a recording sheet is high, a time length after forming of a toner image onto a recording sheet until starting of the next toner image forming is made long, thereby controlling a start timing of the next toner image forming is controlled to be delayed. In this delay control, when a printing rate is high, a delaying time in accordance with the printing rate is read out from a predetermined storing section. A time which is calculated by adding the read delaying time to a default value is set to be the toner image forming start timing for the next toner image forming. In an image forming apparatus adopting the electrophotographic method, there has been a problem that intensity of a toner image formed on a developing roller is lightened when toner particles of a toner layer formed on a developing roller are rapidly consumed. This is because conveyance of toner particles are delayed, and enough amounts of toner particles cannot be supplied from a magnetic roller. However, the image forming apparatus disclosed in the Japanese Unexamined Patent Publication No. 2005-164676 solves the above-described problem by delaying an image forming to not to lighten an intensity of a toner image.

However, in the image forming apparatus disclosed in the Japanese Unexamined Patent Publication No. 2005-164676, waste of work has been generated in a processing requiring calculation of a delaying time since the calculation of delaying time in the above-described toner image forming is performed each time when the printing rate is high.

SUMMARY OF THE INVENTION

The present invention has worked out in view of the points described above, and its object is to enable a delay control of a toner image forming with a simple processing.

The present invention includes an image forming apparatus comprising: an image bearing member; an image processing section for processing raw image data to generate image data suitable for forming a toner image; a toner image forming section for forming a toner image on the image bearing member based on the image data generated by the image processing section; and a delaying section for obtaining from the image processing section a printing rate of the generated image data, and delaying in accordance with the obtained printing rate a start timing of a toner image forming by the toner image forming section. The delaying section modifies the start timing of a present toner image forming by the toner image forming section a predetermined delaying time when a printing rate of image data for the preceding toner image forming and a printing rate of image data for the present toner image forming are different from each other. The predetermined delaying time is predetermined in accordance with a printing rate of present image data.

According to the invention, the delaying section modifies the start timing of a present toner image forming by the toner image forming section a predetermined delaying time, which is predetermined in accordance with a printing rate of present toner image data, when a printing rate of image data for the preceding toner image forming and a printing rate of image data for the present toner image forming are different from each other. Accordingly, the situation where a toner intensity is lightened due to a shortage of toner particles can be avoided in an appropriate manner, thereby enabling an appropriate image forming. Since the start timing of the present toner image forming by the toner image forming section is modified only when the printing rates are different from each other, no wasteful delaying time is spent for calculating the delaying time of the toner image forming each time when it is found that the printing rate is high, unlike the delay control by the conventional image forming apparatus. Therefore, the delay control of a toner image forming can be realized with a simple processing.

These and other objects, features, and advantages of the present invention will become more apparent upon reading of the following detailed description along with the accompanied drawings.

BRIEF DESCRIPTION OF THE DRAWINGS

FIG. 5 is a diagram showing data which a delay controller stores.

DETAILED DESCRIPTION OF THE PREFERRED EMBODIMENTS

Figure 1:
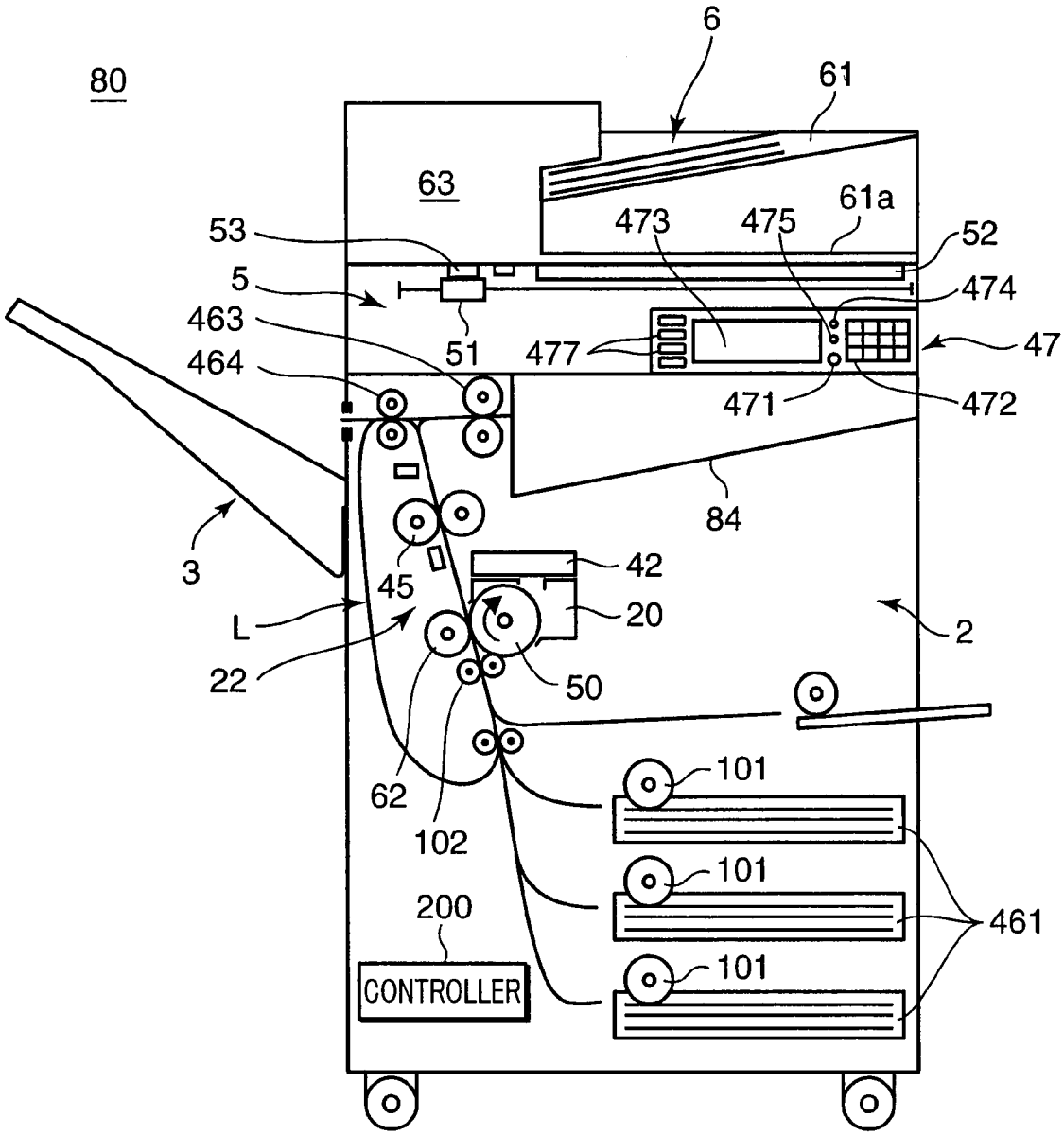
FIG. 1 is a side view schematically showing an internal configuration of a copying machine which is an example of an image forming apparatus according to an embodiment of the present invention.

Hereinafter, an embodiment of the present invention will be described with reference to drawings. FIG. 1 is a side view schematically showing an internal configuration of a complex machine which is an example of an image forming apparatus according to an embodiment of the present invention. A complex machine 80 has functions such as a copying function, a printer function, a scanner function, and a facsimile function. The complex machine 80 includes a main body 2, a stack tray 3 provided in a left side portion of the main body 2, a document reading section 5 provided on an upper portion of the main body 2 and a document feeding section 6 provided in an upper portion of the document reading section 5.

Further, in a front portion of the complex machine 80, there is provided an operating section 47. In the operating section 47, there are provided a start key 471, numerical keys 472, a display portion 473, a reset key 474, a stop key 475 and a function switching key 477. The start key 471 is adapted for allowing an operator to input a printing instruction. The numerical keys 472 are adapted for allowing an operator to input the number of copies or the like. The display portion 473 is adapted for displaying guide information of various copying operations and includes a liquid crystal display having a touch-panel function for allowing an operator to input the various settings. The reset key 474 is adapted for resetting contents set through the display portion 473. The stop key 475 is adapted for suspending a printing (image forming) operation being in progress. The function switching key 477 is adapted for switching functions between a copying function, a printer function, a scanner function and a facsimile function.

The document reading section 5 includes a scanner portion 51, a document holder 52 and a document reading slit 53. The scanner portion 51 has a CCD (Charge Coupled Device) sensor and an exposure lamp. The document holder 52 is constructed by a transparent member such as a glass. The scanner portion 51 is so constructed as to be movable by an unillustrated driver. At the time of reading a document placed on the document holder 52, the scanner portion 51 moves along the document holder 52 in an area facing a document surface, and scans a document image to obtain image data. The image data obtained by scanning the document image is outputted to a controller 200. At the time of reading a document fed by the document feeding section 6, the scanner portion 51 moves to a position facing the document reading slit 53, obtains image data of the document by reading an image of the document through the document reading slit 53 in synchronization with an operation of conveying the document by the document feeding section 6, and then outputs the image data to the controller 200.

The sheet feeding section 6 includes a document holding portion 61, a document discharging portion 61*a* and a document conveying mechanism 63. The document holding portion 61 is adapted for holding a document. The document discharging portion 61*a* is adapted for discharging a document whose image is read out. The document conveying mechanism 63 includes a sheet feeding roller (unillustrated) and a conveying roller (unillustrated) for conveying documents placed on the document holding portion 61 one after another to a position facing the document reading slit 53 and discharging the documents to the document discharging portion 61*a*. The document conveying mechanism 63 further includes a sheet reversing mechanism (unillustrated) for reversing the sides of a document and conveying again to the position facing the document reading slit 53, thereby making it possible to read images of both sides of a document by the scanner portion 51.

Further, the document feeding section 6 is provided rotatably on the main body 2 so that the front surface side of the document feeding section 6 is moved upward. By making the upper surface of the document holder open by moving the front surface side of the document feeding portion 6 upward, an operator can place on the upper surface of the document holder 52 a document which is to be read e.g. an opened book.

The main body 2 includes a plurality of sheet feeding cassettes 461, sheet feeding rollers 101 and an image forming section 22. The sheet feeding rollers 101 are adapted for taking out recording sheets one after another from the sheet feeding cassettes 461 and conveying the recording sheets to the image forming section 22. The image forming section is adapted for forming a toner image on the recording sheet conveyed from the sheet feeding cassette 461.

The image forming section 22 includes an optical unit 42, a developing portion 20, a transferring roller 62, a fixing portion 45 and conveying rollers 463, 464. The optical unit irradiates a laser light to a photoconductive drum 50 based on image data or the like obtained in the scanner portion 51. The developing portion 20 is adapted for forming a toner image on the photoconductive drum 50. The transferring roller 62 is adapted for transferring a toner image formed on the photoconductive drum 50 to the recording sheet. The fixing portion 45 is adapted for heating the recording sheet onto which the toner image is transferred to fix the toner image on the recording sheet. The conveying rollers 463, 464 are provided in a sheet conveying passage in the image forming section 22 and convey the recording sheet to the stack tray 3 or a discharging tray 84.

Further, in the case of forming images on both sides of a recording sheet, an image is formed on one side of the recording sheet in the image forming section 22, and thereafter the recording sheet is nipped by the conveying rollers 463 on the side of the discharging tray 84. In this state, the conveying rollers 463 are rotated backward to switch back the recording sheet, and the recording sheet is sent to a sheet conveying passage L and conveyed again to upstream area of the image forming section 22. After an image is formed on other side of the recording sheet by the image forming section 22, the recording sheet is discharged to the stack tray 3 or the discharging tray 84.

Figure 2:
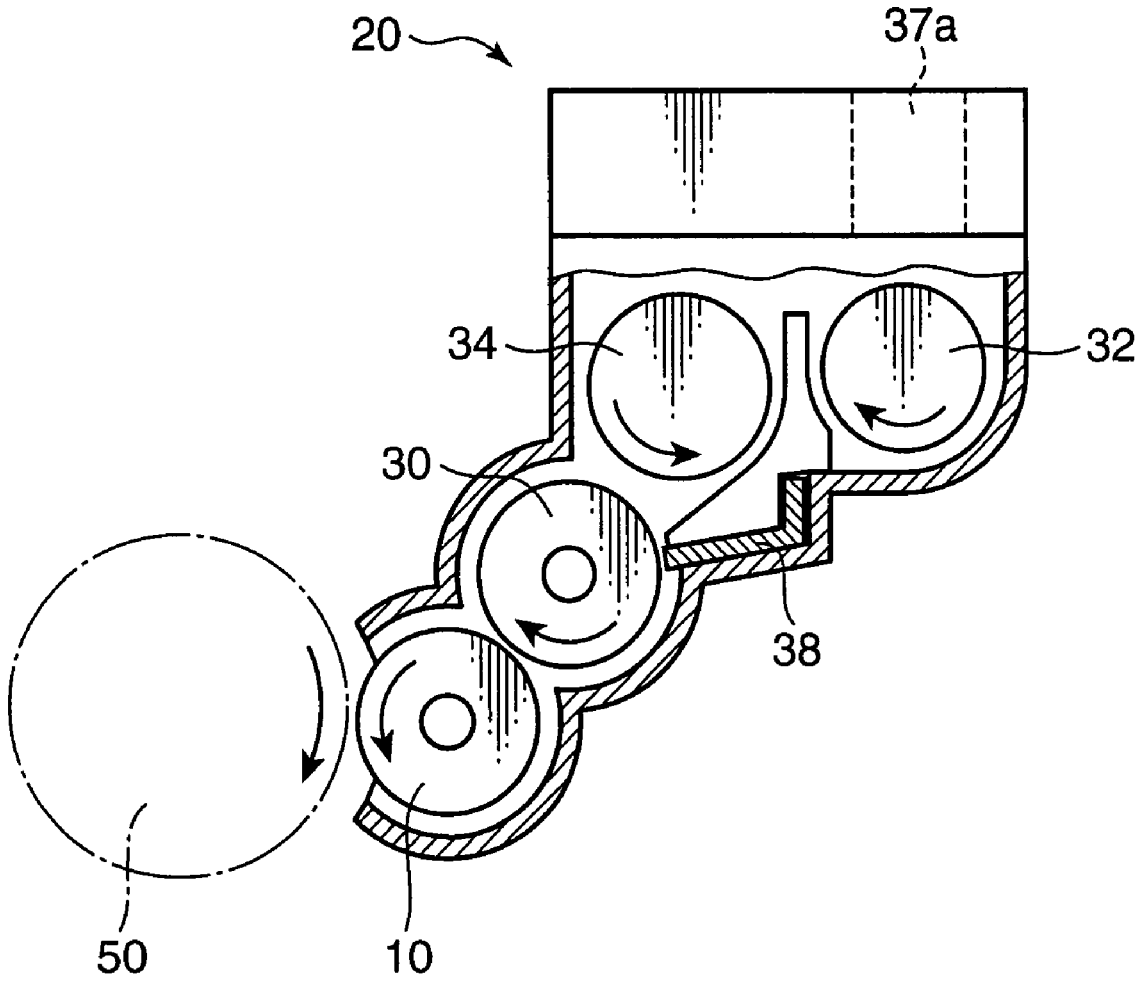
FIG. 2 is an explanatory diagram showing a detailed configuration of a developing device by enlarging a part of FIG. 1.

FIG. 2 is an explanatory diagram showing a detailed configuration of the developing device 20 by enlarging a part of FIG. 1.

The developing device 20 is formed with a toner supplying hole 37*a* and includes an agitating mixer 32 and a paddle mixer 34, a magnetic roller 30, a restricting blade 38 and a developing roller 10. The toner supplying hole 37*a* is adapted for receiving toner particles supplied from a toner cartridge (unillustrated). The agitating mixer 32 and the paddle mixer 34 are adapted for mixing and agitating toner particles and carriers to charge the toner particles with electricity. The magnetic roller 30 is adapted for holding carriers on its outer surface to form a magnetic brush. The restricting blade 38 is provided in proximity to the magnetic roller 30 and is adapted for controlling a thickness of the magnetic brush. The developing roller 10 is supplied with toner particles from the magnetic brush whose thickness is controlled, and forms on its outer surface a thin toner layer.

The magnetic roller 30 includes a magnetic body inside. When the magnetic roller 30 receives a supply of developer (toner and carrier) mixed and agitated by the agitating mixer 32 and the paddle mixer 34, it absorbs carrier particles on its outer surface by magnetic force of the magnetic body provided therein and makes toner particles accompanied on the magnetic brush.

The restricting blade 38 forms a predetermined thickness of the magnetic brush by trimming the magnetic brush.

On the other hand, the developing roller 10 is applied with a direct-current bias (referred to as "Vd1") by a direct-current power source. On the other hand, the magnetic roller 30 is applied with a direct-current bias (referred to as "Vd2") is applied. In accordance with the potential difference $|Vd2-Vd1|$ between the direct-current bias Vd1 and the direct-current bias Vd2, toner particles attached to the magnetic brush formed on the magnetic roller 30 are transferred to the developing roller 10. Accordingly, a thin toner layer is formed on the peripheral surface of the developing roller 10.

Then, the developing roller 10 selectively makes toner particles move from the thin toner layer formed on the outer peripheral surface to an electrostatic latent image formed on the facing photoconductive drum 50 (having a lower electric potential than its periphery) so that a toner image is formed on the photoconductive drum 50.

In the developing device 20, if toner images are formed consecutively on the photoconductive drum 50 in a short period of time, toner particles of the thin toner layer formed on the surface of the developing roller 10 are likely to be consumed fast. Although toner particles are newly supplied to the developing roller 10 during that time, a defect toner image having a low intensity is formed on the photoconductive drum 50 if a balance between a reduced amount and a newly supplied amount is broken.

With that, in the complex machine 80, a delay controller 220 (FIG. 3) controls a time between the start of the preceding toner image forming and the start of the present toner image forming long (in other words, delaying the start timing of the present toner image forming). Accordingly, the number of times at which the developing roller 10 form toner images on the photoconductive drum 50 in a unit of time is controlled, and formation of a defect toner image having a low intensity is avoided.

In the complex machine 80, the controller 200 changes a cycle of operation of the image forming section 22 in accordance with a delaying time determined by the delay controller 220. The controller 100, in synchronization with the changes based on the delay control, changes conveyance intervals of a sheet conveying mechanism 300 conveying a recording sheet to a toner image transferring position of the photoconductive drum 50.

It should be noted that a time period between a time point when a leading end of a preceding recording sheet reaches the toner image transferring position of the photoconductive drum 50 and a time point when a leading end of a next recording sheet reaches the toner image transferring position of the photoconductive drum 50 is referred to as a sheet interval time.

It will be described specifically. Between the sheet feeding roller 101 and the image forming section 22, there is provided a registration roller 102. The registration roller 102 temporarily holds at its predetermined portion a recording sheet. After synchronizing with operation of the image forming section 22, the registration roller 102 starts conveying the held recording sheet to the side of the image forming section 22. Accordingly, intervals of conveying the recording sheet is changed and synchronized with the change of operation interval of the image forming section 22.

Toner particles on the developing roller 10 are rapidly consumed as a printing rate (a ratio of dots bearing toner particles with respect to all dots in print image data) of a toner image formed by the developing roller 10 is high. Therefore, in the complex machine 80, the delay controller 220 changes a time interval of the start timing of the present toner image forming and the start timing of the preceding toner image forming (hereinafter, referred to as toner image forming interval), and the above-described sheet interval time in accordance with a printing rate. More specifically, since amount of toner particles consumed at each image forming as a printing rate is higher, the delay controller 220 makes the toner image forming interval and the sheet interval time longer in correspondence with the consumed amount.

If the toner image forming interval and the sheet interval time becomes long, a time for completing a next image forming after an image is formed becomes long. In the complex machine 80, the delay controller 220 delays image forming by making the toner image forming interval and the sheet interval time long. Accordingly, during the delayed period, a necessary amount of toner particles for forming the next toner image forming can be supplied to the developing roller 10.

Figure 3:
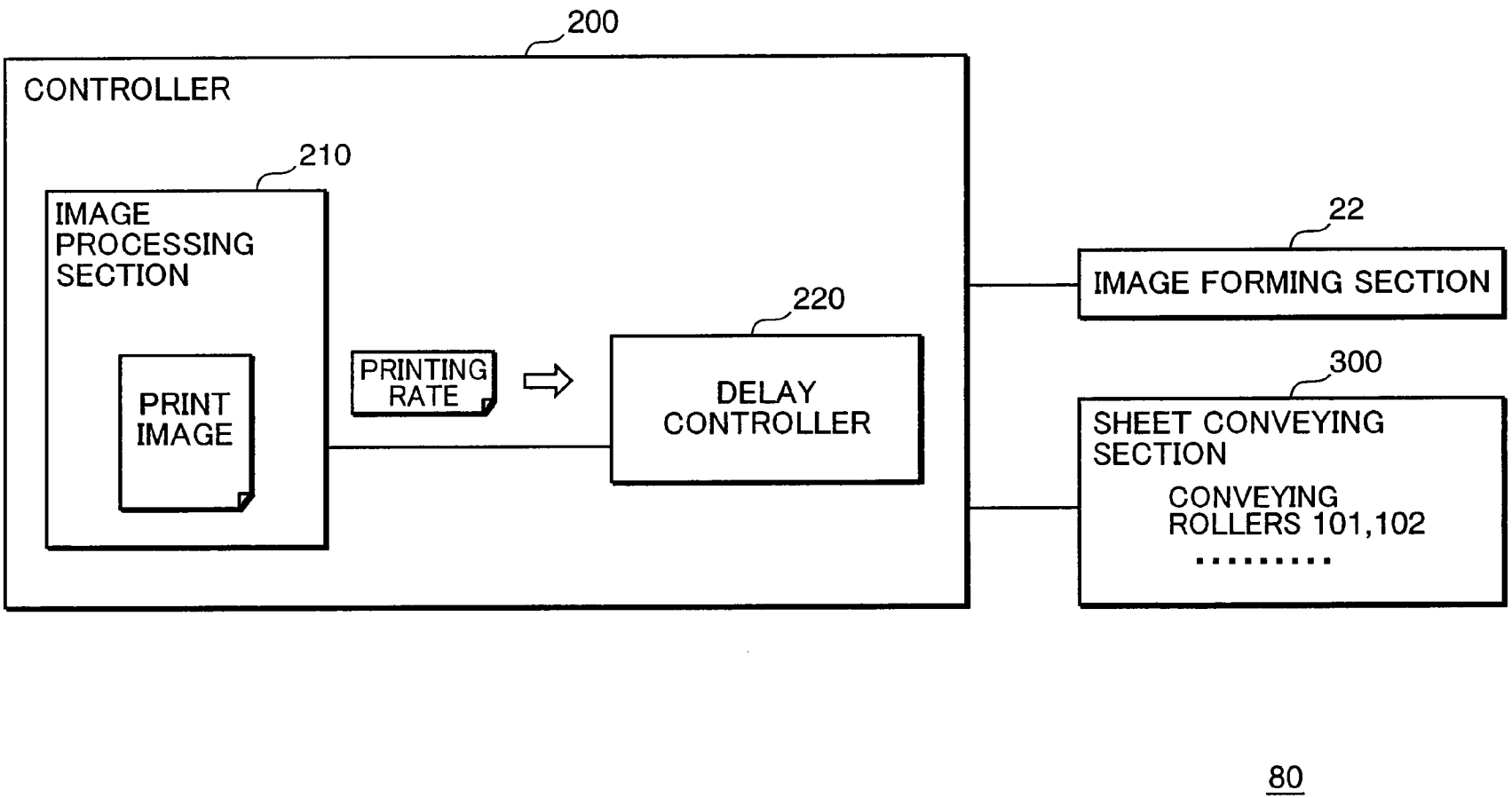
FIG. 3 is an explanatory diagram showing blocks of functions realized by a controller.

FIG. 3 is an explanatory diagram showing blocks of functions realized by a controller 200.

The controller 200 controls operations of the image forming section 22 and the sheet conveying mechanism 300 to make respective portions perform an image forming. The controller includes an image processing section 210 and the delay controller 220.

The image processing section 210 performs an image processing of converting print object data (raw data) to data suitable for a toner image forming. The image processing section 210 calculates a printing rate of an image to be printed. The image processing section 210 transmits calculated printing information to the delay controller 220. For example, the image processing section 210 specifies a printing rate by finding out a ratio of the number of dots to carry toner particles with respect to all dots regarding image data to be printed.

The delay controller 220 determines the toner image forming interval and the sheet interval time based on a printing rate calculated by the image processing section 210. When the delay controller 220 determines the toner image forming interval and the sheet interval time, the controller 200 controls a control signal which is transmitted to the image forming section 22 and the sheet conveying mechanism 300 based on the determined toner image forming interval and the sheet interval time. Accordingly, the image forming section 22 and the recording sheet conveying mechanism 300 performs image forming with the determined toner image forming interval and the sheet interval time.

Hereinafter, how the delay controller 220 determines the sheet interval time will be described in detail with reference to FIGS. 4 and 5.

Figure 4:
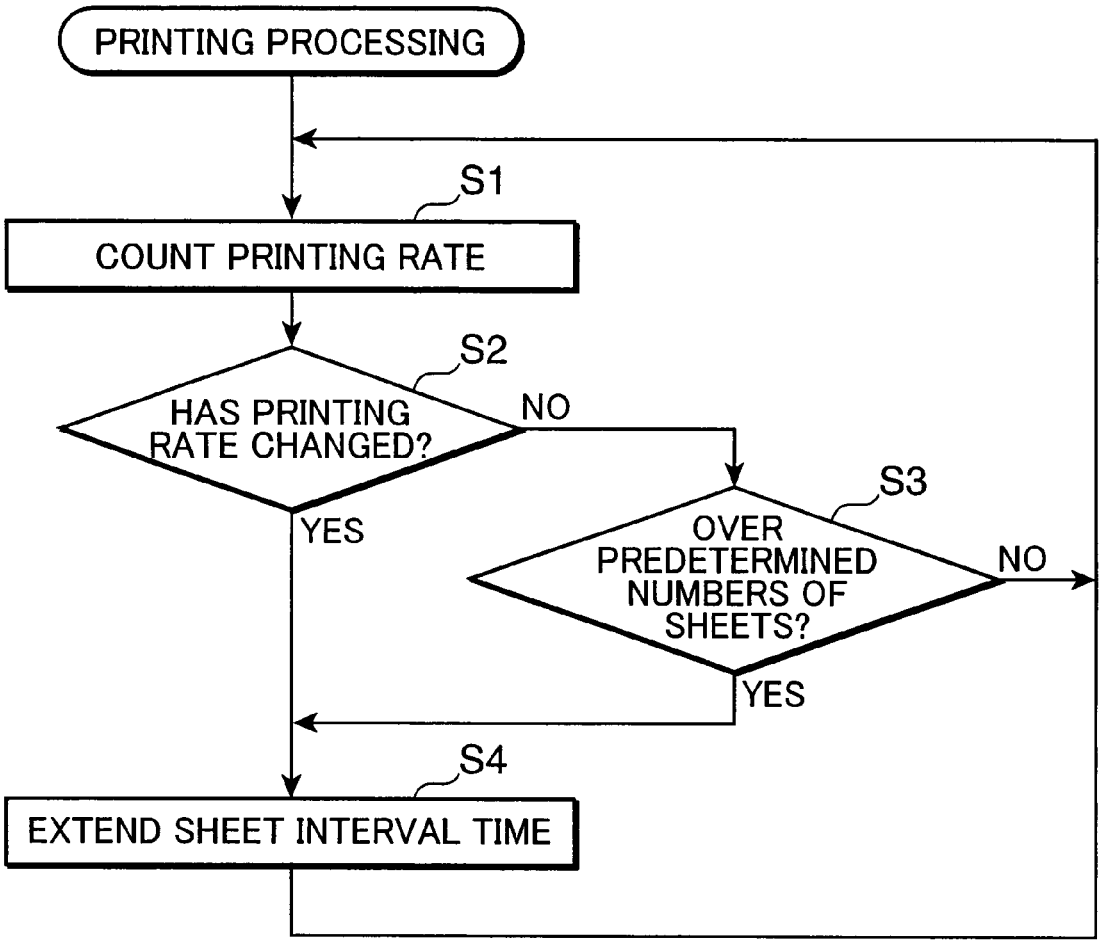
FIG. 4 is a flowchart showing an operation of the copying machine.

FIG. 4 is a flowchart showing an operation of the complex machine 80. The processing shown in FIG. 4 is performed, for example, when a printing operation is consecutively performed in the complex machine 80 (for example, in a case where printing is performed to a plurality of recording sheets in a period of time shorter than 5.0 seconds).

In Step S1, the image processing section 210 calculates a printing rate of an image to be printed next.

In Step S2, based on the printing rate calculated in Step S1, the delay controller 220 determines whether or not the printing rate is changed. More specifically, the delay controller 220 compares with a printing rate of a past image printed on a recording sheet last time, and determines whether or not a printing rate of a present image to be printed next is changed.

In the case where the printing rates are changing (Step S2: YES), the delay controller 220 performs a control to delay a toner image forming in Step S4.

FIG. 5 is a diagram showing data which the delay controller 220 stores. The delay controller 220 stores contents of the table shown in FIG. 5. In Step S4 in FIG. 4, the delay controller 220 determines a start timing of the present toner image forming based on the contents of the table.

Specifically, the delay controller 220 delays the start timing of the present toner image forming by the image forming section 22 a delaying time stored in correspondence with a printing rate of an image to be formed in the present toner image forming by the image forming section 22. In other words, for example, when a printing rate which is calculated by the image processing section 210 in S1 of an image to be formed in the present toner image forming is 45%, the delay controller 220 delays 500 msecs the start timing of the present toner image forming by the image forming section 22 since the delaying time stored in correspondence with the printing rate of 45% is 500 (msecs). In other words, the delay controller 220 makes only 500 msecs longer the interval (time) between the start timing of the toner image forming in the past printing (previous printing) and the start timing of the present toner image forming by the image forming section 22. Accordingly, in the present printing performed next, according to the above-described delay, sufficient time for supplying necessary amount of toner particles for the present toner image forming is secured so that printing deficiency due to light toner can be prevented. Then, at the time of the next printing after the image forming is completed, the routine goes back to Step S1 and the same processing is repeated.

As shown in the table in FIG. 5, in the case where the printing rates are different, the delay controller 220 delays the start timing of a toner image forming when a printing rate of image data used for the present toner image forming by the image forming section 22 is a predetermined high printing rate.

On the other hand, in Step S2, if a printing rate of a previous image printed last time is the same as a printing rate of an image to be printed next (Step S2: NO), the delay controller 220 detects in Step S3 how many recording sheets are printed consecutively with that printing rate at the time when the previous printing is completed, and determines whether or not the number of sheets is more than the predetermined number of sheets.

In other words, as shown in FIG. 5, the delay controller 220 stores the predetermined number of sheets in correspondence with printing rates. The delay controller 220 performs the aforementioned determination by using the predetermined number of sheets stored in correspondence with a printing rate (same as the printing rate of the previous image) of the present image to be printed next.

Then, according to the result of the determination, if it is over the predetermined number of sheets (Step S3: YES), the delay controller 220 reads out a delaying time corresponding to a printing rate of the present image from the table in FIG. 5 which the delay controller 220 stores, and delays the start timing of the present toner image forming by the image forming section 22 with the read delaying time (Step S4).

On the other hand, if it is not over the predetermined number of sheets (Step S3: NO), the delay controller 220 does not delay the start timing of the present toner image forming by the image forming section. Thereafter, the routine goes back to Step S1.

In the case where the printing rates are equal as described above, the delay controller 220 delays the start timing of a toner image forming when a printing rate of image data used for the present toner image forming by the image forming section 22 is the predetermined high printing rate as shown in the table in FIG. 5, and the number of sheets printed consecutively at the printing rate is over the predetermined number of sheets stored in correspondence with the printing rate.

Further, in S2, the delay controller 220 performs the determination of whether or not the printing rates in the previous image forming and the present image forming is changed by comparing directly with the values of the printing rates. However, instead of the processing, the delay controller 220 may determine that the printing rates are the same when the image forming section 22 performs image forming consecutively based on the same image data processed in the image processing section. Further, the delay controller 220 may determine that the printing rates are different from each other when the image forming section 22 does not performed image forming consecutively based on the same image data processed in the image processing section 210. In other words, in the case where the image forming section 22 consecutively performs printing to a plurality of recording sheet based on the same image data, the delay controller 220 determines that the printing rates are equal, and does not perform direct comparison of the values of the printing rates.

Hereinafter, another embodiment will be described.

Figure 6:
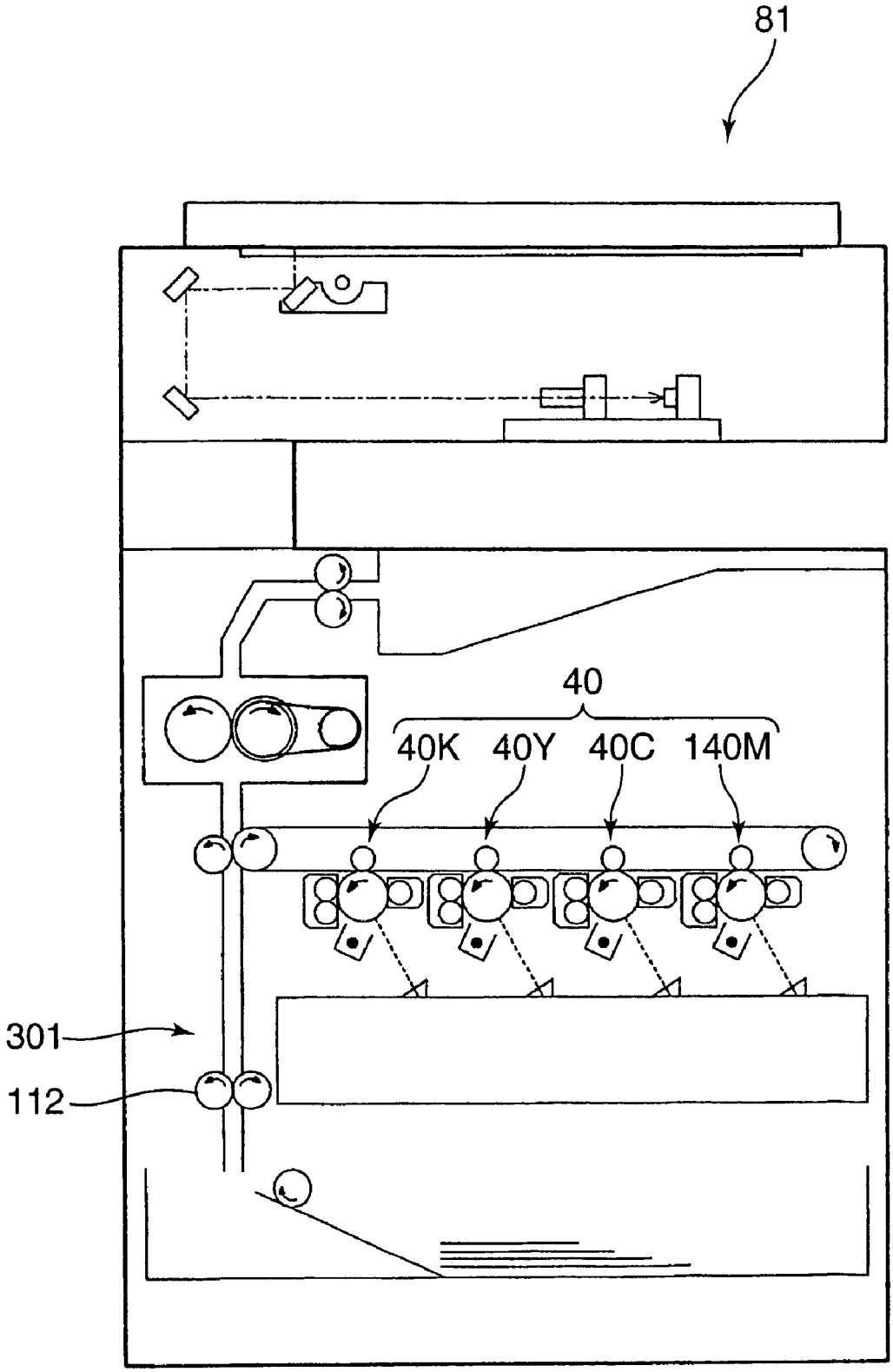
FIG. 6 is a side view schematically showing an internal configuration of a copying machine which is an example of an image forming apparatus according to another embodiment of the present invention.

The above-described complex machine 80 is so constructed as to form a monochromatic image. However, the present invention may be applied to an image forming apparatus for forming a color image. FIG. 6 is a view schematically showing a color complex machine 81 according to another embodiment of the present invention. As shown in FIG. 6, the color complex machine 81 includes a plurality of image forming mechanisms 40 for respective colors necessary for forming a color image. Each image forming mechanism 40 includes a photoconductive drum 50, a developing portion 20 and a transferring roller 62. The image forming mechanisms 40 for respective colors are controlled by a controller 200 having the same construction as the complex machine 80.

In the complex machine 81, the delay controller 220 performs the same processing shown in FIG. 4. However, when in the case where printing rates of a toner image forming mechanism 40 showing the highest value of a printing rate in the preceding (previous) toner image forming and a toner image forming mechanism 40 showing the highest value of a printing rate in the present toner image forming among the toner image forming mechanisms 40 for respective colors are equal, the delay controller 220 does not delay the start timing of the present toner image forming by the toner image forming mechanisms 40 for respective colors. When the printing rates are different from each other, the delaying section 220 delays the start timing of the present toner image forming by the toner image forming sections 40 for respective colors a predetermined delaying time. The predetermined delaying time is predetermined in accordance with the table shown in FIG. 5.

Further, in the complex machine 81, even in the case where printing rates of a toner image forming section 40 showing the highest value of a printing rate in the preceding toner image forming and a toner image forming section 40 showing the highest value of a printing rate in the present toner image forming among the toner image forming sections 40 for respective colors are equal, the delay controller 220 delays the start timing of the present toner forming a predetermined delaying time when the toner image forming by the toner image forming sections 40 is preformed more than the predetermined numbers of times. The predetermined delaying time is predetermined in accordance with the table shown in FIG. 5 for the printing rate showing the highest value of a printing in the present toner image forming.

Further, in S2 of FIG. 4, the delay controller 220 may determine that the printing rates are equal when the toner image forming sections 40 for respective colors form images based on the same image data generated in the image processing section 210, or may determine that the printing rates are not equal when the image forming section 22 does not form images consecutively based on the same image data generated in the image processing section 210. In other words, in the case where the image forming sections 40 for respective colors perform printings consecutively to a plurality of recording sheets based on the same image data, the delay controller 220 determines that the printing rates are equal, and does not performs direct comparison of the values of the printing rates.

In this complex machine 81, when the delay controller determines delaying time in a manner as described above, the controller 200 controls a control signal which is transmitted to the image forming section 22 and the conveying mechanism 201 including the conveying roller 112 and its driving mechanism in such a manner that the toner image forming interval and the sheet interval time becomes the ones based on the determined delaying time. Accordingly, the image forming section 40 and the sheet conveying mechanism 301 performs an image forming with the determined toner image forming interval and the sheet interval.

The complex machine 81 includes the image forming section 40 for respective colors each having the photoconductive drum 50, the developing section 20 and the transferring roller 62. However, the present invention may be applied to a color printing complex machine performing a color image provided with a single photoconductive drum around which the developing sections 20 and the transferring rollers 62 for respective colors are positioned.

Further, the present invention is not limited to the case of applying it to a complex machine as described above. It may be applied to various kinds of image forming apparatuses such as a facsimile machine, a printing device and a complex machine.

Specifically, the present invention includes an image forming apparatus comprising: an image bearing member; an image processing section for processing raw image data to generate image data suitable for forming a toner image; a toner image forming section for forming a toner image on the image bearing member based on the toner image data generated by the image processing section; and a delaying section for obtaining from the image processing section a printing rate of the generated image data, and delaying in accordance with the obtained printing rate a start timing of a toner image forming by the toner image forming section. The delaying section modifies the start timing of a present toner image forming by the toner image forming section a predetermined delaying time when a printing rate of image data for the preceding toner image forming and a printing rate of image data for the present toner image forming are different from each other, the predetermined delaying time being predetermined in accordance with a printing rate of present image data.

According to the invention, the delaying section modifies the start timing of a present toner image forming by the toner image forming section a predetermined delaying time, which is predetermined in accordance with a printing rate of present toner image data, when a printing rate of image data for the preceding toner image forming and a printing rate of image data for the present toner image forming are different from each other. Accordingly, the situation where a toner intensity is lightened due to a shortage of toner particles can be avoided in an appropriate manner, thereby enabling an appropriate image forming. Since the start timing of the present toner image forming by the toner image forming section is modified only when the printing rates are different from each other, no wasteful delaying time is spent for calculating the delaying time of the toner image forming each time when it is found that the printing rate is high, unlike the delay control by the conventional image forming apparatus. Therefore, the delay control of a toner image forming can be realized with a simple processing.

Further, according to the present invention, in the case where a printing rate of image data for the preceding toner image forming and a printing rate of image data for the present toner image forming are equal, the delaying section does not delay the start timing of the present toner image forming by the toner image forming section when a toner image forming by the toner image forming section is performed consecutively for the predetermined numbers of times or lower. The delaying section delays the start timing of the present toner image forming a predetermined delaying time when a toner image forming by the toner image forming section is performed consecutively for more than the predetermined numbers of times, the predetermined delaying time being predetermined in accordance with a printing rate of image data for the present toner image forming.

According to the invention, even in the case where a printing rate of image data used in the previous toner image forming and a printing rate of image data used in the present toner image forming are equal, the delaying section delays the start timing of the present toner image forming when a toner image forming by the toner image forming section is performed consecutively for more than the predetermined numbers of times. Accordingly, a situation where a toner intensity is lowered due to a shortage of toner particles can be prevented assuredly.

Further, according to the present invention, in the case where a printing rate of image data for the present toner image forming is a predetermined high printing rate, the delaying section performs the delaying process of the start timing of the toner image forming when the printing rates are equal.

Further, according to the present invention, in the case where the printing rates are different from each other, the delaying section delays the start timing of the present toner image forming when a printing rate of image data for the present toner image forming is the predetermined high printing rate.

Further, according to the present invention, the delaying section determines that the printing rates are equal when the toner image forming section forms toner images on the image bearing member consecutively based on the same image data generated in the image processing section.

Further, according to the present invention, the image forming apparatus further comprises a conveying section for conveying a recording sheet to a toner image transferring position where the toner image is transferred from the image bearing member, wherein; in the case where the start timing of the toner image forming by the toner image forming section is delayed, the delaying section delays, in accordance with the delaying time, a timing of conveying the toner image to the toner image transferring position by the conveying section.

According to the invention, in accordance with a delay in toner image forming by delaying section, a conveyance of a recording sheet by the conveying section is delayed. Accordingly, even in the case where the toner image forming is delayed, an image can be formed assuredly on a recording sheet.

Further, according to the present invention, the image forming apparatus further comprises a plurality of toner image forming sections for respective colors for a color printing, wherein; in the case where printing rates of a toner image forming section showing the highest value of a printing rate in the preceding toner image forming and a toner image forming section showing the highest value of a printing rate in the present toner image forming among the toner image forming sections for respective colors are different from each other, the delaying section delays the start timing of the present toner image forming by the toner image forming sections for respective colors a predetermined delaying time, the predetermined delaying time being predetermined in accordance with the printing rate showing the highest value of a printing rate in the present toner image forming.

Further, according to the present invention, the image forming apparatus further comprises a plurality of toner image forming sections for respective colors for a color printing, wherein; in the case where printing rates of a toner image forming section showing the highest value of a printing rate in the preceding toner image forming and a toner image forming section showing the highest value of a printing rate in the present toner image forming among the toner image forming sections for respective colors are equal, the delaying section does not delay the start timing of the present toner image forming by the toner image forming sections for respective colors when the toner image forming by the toner image forming sections is performed consecutively for the predetermined numbers of times or lower; and the delaying section delays the start timing of the present toner image forming by the toner image forming sections a predetermined delaying time when the toner image forming by the toner image forming sections is performed more than the predetermined numbers of times, the predetermined delaying time being predetermined in accordance with the printing rate showing the highest value of a printing rate in the present toner image forming.

Further, according to the present invention, the delaying section determines that the printing rates are equal when the toner image forming sections for respective colors form images on the image bearing member consecutively based on the same image data generated in the image processing section.

This application is based on Japanese Patent application serial No. 2006-125948 filed in Japan Patent Office on Apr. 28, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

an image bearing member;

an image processing section for processing raw image data to generate image data suitable for forming a toner image;

a toner image forming section for forming a toner image on the image bearing member based on the toner image data generated by the image processing section; and a delaying section for obtaining from the image processing section a printing rate of the generated image data, and delaying in accordance with the obtained printing rate a start timing of a toner image forming by the toner image forming section, wherein; the delaying section modifies the start timing of a present toner image forming by the toner image forming section a predetermined delaying time when a printing rate of image data for the preceding toner image forming and a printing rate of image data for the present toner image forming are different from each other, the predetermined delaying time being predetermined in accordance with a printing rate of present image data.

2. The image forming apparatus according to claim 1, wherein; in the case where a printing rate of image data for the preceding toner image forming and a printing rate of image data for the present toner image forming are equal, the delaying section does not delay the start timing of the present toner image forming by the toner image forming section when a toner image forming by the toner image forming section is performed consecutively for the predetermined numbers of times or lower; and the delaying section delays the start timing of the present toner image forming a predetermined delaying time when a toner image forming by the toner image forming section is performed consecutively for more than the predetermined numbers of times, the predetermined delaying time being predetermined in accordance with a printing rate of image data for the present toner image forming.

3. The image forming apparatus according to claim 2, wherein; in the case where a printing rate of image data for the present toner image forming is a predetermined high printing rate, the delaying section performs the delaying process of the start timing of the toner image forming when the printing rates are equal.

4. The image forming apparatus according to claim 1, wherein; in the case where the printing rates are different from each other, the delaying section delays the start timing of the present toner image forming when a printing rate of image data for the present toner image forming is the predetermined high printing rate.

5. The image forming apparatus according to claim 1, wherein; the delaying section determines that the printing rates are equal when the toner image forming section forms toner images on the image bearing member consecutively based on the same image data generated in the image processing section.

6. The image forming apparatus according to claim 1, further comprising a conveying section for conveying a recording sheet to a toner image transferring position where the toner image is transferred from the image bearing member, wherein; in the case where the start timing of the toner image forming by the toner image forming section is delayed, the delaying section delays, in accordance with the delaying time, a timing of conveying the toner image to the toner image transferring position by the conveying section.

7. The image forming apparatus according to claim 1, further comprising a plurality of toner image forming sections for respective colors for a color printing, wherein; in the case where printing rates of a toner image forming section showing the highest value of a printing rate in the preceding toner image forming and a toner image forming section showing the highest value of a printing rate in the present toner image forming among the toner image forming sections for respective colors are different from each other, the delaying section delays the start timing of the present toner image forming by the toner image forming sections for respective colors a predetermined delaying time, the predetermined delaying time being predetermined in accordance with the printing rate showing the highest value of a printing rate in the present toner image forming.

8. The image forming apparatus according to claim 1, further comprising a plurality of toner image forming sections for respective colors for a color printing, wherein; in the case where printing rates of a toner image forming section showing the highest value of a printing rate in the preceding toner image forming and a toner image forming section showing the highest value of a printing rate in the present toner image forming among the toner image forming sections for respective colors are equal, the delaying section does not delay the start timing of the present toner image forming by the toner image forming sections for respective colors when the toner image forming by the toner image forming sections is performed consecutively for the predetermined numbers of times or lower; and the delaying section delays the start timing of the present toner image forming by the toner image forming sections a predetermined delaying time when the toner image forming by the toner image forming sections is performed more than the predetermined numbers of times, the predetermined delaying time being predetermined in accordance with the printing rate showing the highest value of a printing rate in the present toner image forming.

9. The image forming apparatus according to claim 7, wherein the delaying section determines that the printing rates are equal when the toner image forming sections for respective colors form images on the image bearing member consecutively based on the same image data generated in the image processing section.

10. The image forming apparatus according to claim 8, wherein the delaying section determines that the printing rates are equal when the toner image forming sections for respective colors form images on the image bearing member consecutively based on the same image data generated in the image processing section.

11. The image forming apparatus according to claim 7, further comprising a conveying section for conveying a recording sheet to a toner image transferring position where the toner image is transferred from the image bearing member, wherein; in the case where the start timing of the toner image forming by the toner image forming section is delayed, the delaying section delays, in accordance with the delaying time, a timing of conveying the toner image to the toner image transferring position by the conveying section.

12. The image forming apparatus according to claim 8, further comprising a conveying section for conveying a recording sheet to a toner image transferring position where the toner image is transferred from the image bearing member, wherein; in the case where the start timing of the toner image forming by the toner image forming section is delayed, the delaying section delays, in accordance with the delaying time, a timing of conveying the toner image to the toner image transferring position by the conveying section.

* * * * *